United States Patent [19]

Van der Wilk

[11] Patent Number: 4,950,946

[45] Date of Patent: Aug. 21, 1990

[54] DISPLAY DEVICE COMPRISING A FLAT DISPLAY WINDOW AND LOW-MICROPHONICS LINEAR THERMIONIC WIRE CATHODES

[75] Inventor: Ronald Van der Wilk, Eindhoven, Netherlands

[73] Assignee: U.S. Philips Corporation, New York, N.Y.

[21] Appl. No.: 313,215

[22] Filed: Feb. 21, 1989

[30] Foreign Application Priority Data

Feb. 19, 1988 [NL] Netherlands ..... 8800423

[51] Int. Cl.[5] ..... H01J 19/12; H01J 63/02

[52] U.S. Cl. ..... 313/411; 313/422; 313/495; 313/269

[58] Field of Search ..... 313/411, 422, 495, 269

[56] References Cited

U.S. PATENT DOCUMENTS 4,804,887 2/1989 Miyama et al. ..... 313/422 X

FOREIGN PATENT DOCUMENTS 0266772 5/1988 European Pat. Off. .

*Primary Examiner*—Sandra L. O'Shea

*Attorney, Agent, or Firm*—John C. Fox

[57] ABSTRACT

A display device having in an evacuated envelope a mechanically tensed thermionic linear wire cathode 4 and a bent first electrode 5 having a slit 6. The wire cathode 4 is rendered insensitive to microphonics by means of positioning means 22 which are urged against the slit 6 by the wire cathode 4.

7 Claims, 2 Drawing Sheets

DISPLAY DEVICE COMPRISING A FLAT DISPLAY WINDOW AND LOW-MICROPHONICS LINEAR THERMIONIC WIRE CATHODES

BACKGROUND OF THE INVENTION

The invention relates to a display device comprising an evacuated envelope having a flat display window which is provided with a luminescing phosphor screen, which envelope accommodates a tensed linear thermionic wire cathode for emitting electron and a first electrode having a slit for passing electrons, so that electron beams are formed.

Such a display device is known from U. S. Pat. No. 4,451,758, in which a number of parallel disposed wire cathodes are accommodated in the envelope. A general problem is such a display device is the sensitivity of each tensed wire cathode to vibrations, shocks and the like. Owing to the vibrations of a wire cathode the distance from the wire cathode to the first electrode is not constant, as a result of which the electron beams are formed in an insufficiently uniform manner. This adversely affects the operation of the display device.

OBJECTS AND SUMMARY OF THE INVENTION

It is an object of the invention to provide a display device of the type mentioned in the opening paragraph, in which the sensitivity of a tensed wire cathode to vibrations is substantially reduced, i.e., in which the tensed wire cathode has a low level of microphonics.

To this end, a display device of the type mentioned in the opening paragraph is characterized in that the first electrode is bent and a number of juxtaposed positioning means are present between the linear thermionic wire cathode and the first electrode, the tensed wire cathode urging the positioning means against the slit in the first electrode. The mechanically tensed wire cathode is suitably positioned relative to the first electrode by the positioning means. By constructing the first electrode such that it is bent, the tensed wire cathode urges the positioning means against the slit in the first electrode. Moreover, the positioning means support the wire cathode, thereby precluding vibration of the wire cathode in the places where it is supported by the positioning means. Thus, the positioning means determine the vibration nodes of the wire cathode.

The invention is based on the insight that by means of positioning means the natural frequency of the wire cathode can be increased by reducing the length over which the wire cathode can vibrate freely, i.e., the distance between two juxtaposed positioning means, to a dimension at which the vibration frequency of the wire cathode exceeds the frequencies of the vibrations commonly occurring in display devices.

A preferred embodiment of a display device in accordance with the invention is characterized in that the curvature of the first electrode which ranges between 0.001% and 1% of the length of the first electrode. When bendibng the first electrode over a length exceeding 1% of its length, the deflection of the electron beams is adversely affected to an extent such that it adversely affects the image to be displayed on the luminescing phosphor screen. When bending the first electrode over a length smaller than 0.001% of its length, the mechanical tension which must be applied to the wire cathode in order to urge the positioning means against the first electrode is so large that the wire cathode may become plastically deformed.

A preferred embodiment of a display device in accordance with the invention is characterized in that between each two successive positioning means the distance from the wire cathode to the first electrode varies maximally 15%. A mechanically tensed wire cathode extends along a straight line between two successive positioning means. However, the first electrode is bent, as a result of which the distance from the wire cathode to the first electrode varies between two positioning means. In practice it has been found that, for the given curvature, this variation has a negligible effect on the formation of electron beams by the first electrode, provided that it does not exceed 15%. In the case of a larger variation it has been found that the influence on the formation of electron beams is not entirely negligible.

A further preferred embodiment of a display device in accordance with the invention is characterized in that the distance between two different pairs of juxtaposed positioning means differs. Due to this, the free vibration length of the wire cathode between two different pairs of juxtaposed positioning means differs also. Consequently, the wire cathode has a different vibration frequency on either side of a positioning means. Vibrations of a wire-cathode part located between a pair of positioning means do not excite a wire-cathode part located between another pair of positioning means. Consequently, the wire cathode is even less sensitive to vibrations.

In an embodiment of a display device in accordance with the invention, to obtain a properly operating display device the positioning means are advantageously manufactured from electrically insulating material.

In practice, a proper spacing and electrical insulation between the wire cathode and a first electrode are obtained when the positioning means are at least partly disc-shaped and provided on the wire cathode.

Both display devices comprising only one thermionic wire cathode and display devices comprising a number of parallel disposed mechanically tensed linear thermionic wire cathodes having a first electrode for each wire cathode are known. Display devices of the latter type are less sensitive to vibrations when, in an embodiment in accordance with the invention, they are characterized in that each wire cathode is positioned relative to the associated first electrode by means of positioning means, and in that each first electrode is bent.

BRIEF DESCRIPTION OF THE DRAWINGS

The invention will now be explained in greater detail by means of a few embodiments and with reference to a drawing, in which.

DESCRIPTION OF THE PREFERRED EMBODIMENTS

Figure 1:
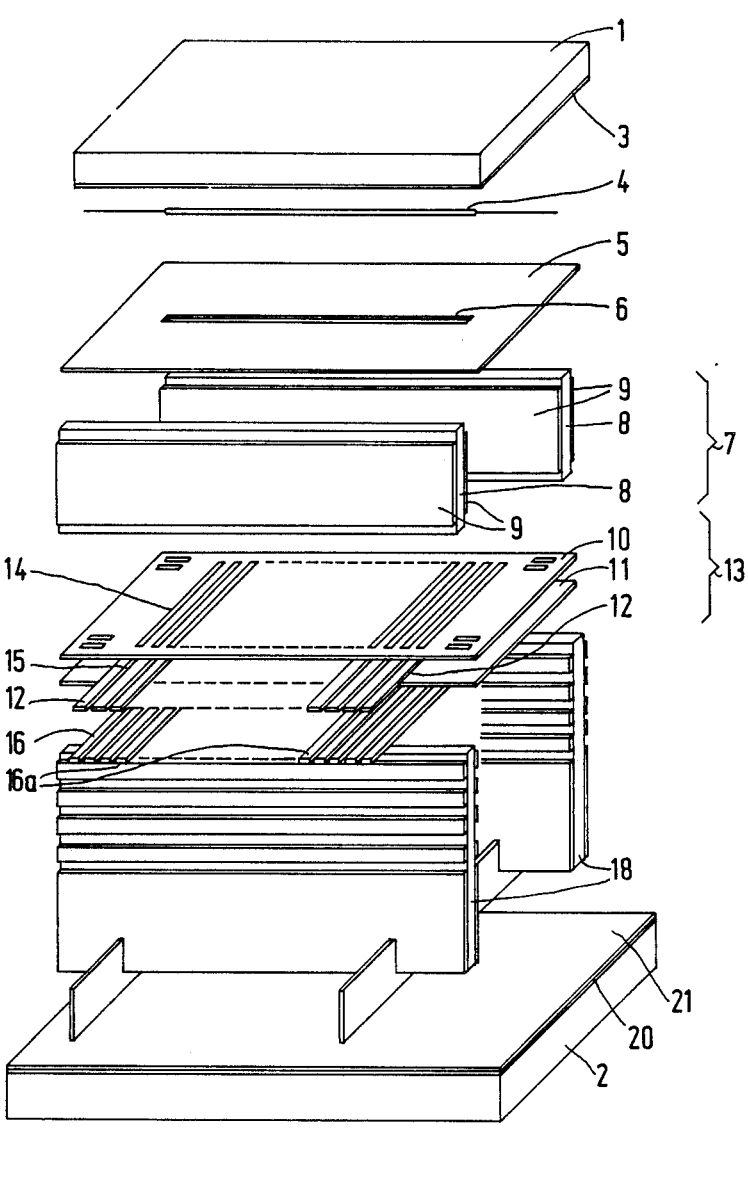
FIG.1 PRIOR ART
FIG. 1 is a diagrammatic view of a segment of a display device in accordance with the present state of the art.

FIG. 1 diagrammatically shows one segment of a display device as described in U.S. Pat. No. 4,451,758. The display device comprises a number of such segments and also a box-shaped evacuated glass envelope. In FIG. 1 a part of a rear wall 1 and a part of a flat display window 2 of the evacuated envelope are shown. The side walls of the evacuated envelope are not shown.

An electrode 3 is provided on the inside of the rear wall 1 of the envelope, for example, by means of vacuum deposition of aluminium. A mechanically tensed thermionic linear wire cathode 4 is arranged parallel to the electrode 3. The wire cathode 4 is manufactured, for example, by coating a tungsten wire having a diameter of from 10 to 20 μm with an electron-emitting oxide. The oxide emits electrons by heating the wire cathode 4. A first electrode 5 having a slit 6 for passing electrons is disposed parallel to the wire cathode 4. The slit 6 is positioned relative to the wire cathode 4 such that the electron beams emerge from the slit 6 at an angle perpendicular to the plane of the first electrode 5. Viewed in the direction of the electron beams, the first electrode is succeeded by a first set of deflection electrodes 7 for vertically deflecting the electrons. The deflection electrode 7 comprises a series of parallel disposed strip-shaped conductors 9 which are provided on both sides of the substrates 8. The substrates 8 extend substantially perpendicularly to the first electrode 5. Each facing pair of conductors 9 forms a pair of vertical deflection electrodes across which a vertical deflection voltage is applied, for example a saw-tooth voltage, such that the electrons passing through the apertures 6 are subject to a vertical deflection. The vertical deflection electrode 7 is succeeded by a control electrode 13 for controlling the current of the electron beams. The control electrode 13 comprises a second electrode 10, a number of strip-shaped control electrodes 12 and a third electrode 11. The second electrode 10 comprises a number of slits 14 extending perpendicularly to the plane of the conductors 9 which are provided on the substrates 8. The strip-shaped control electrodes 12 are arranged parallel to each other in a plane parallel to the second electrode 10, and slits 15 which are in line with the slits 14 are provided between the strip-shaped control electrodes 12. The third electrode 11 is parallel to the second electrode 10 and comprises slits which correspond to the slits 14. The control electrode 13 is succeeded by a second set of deflection electrodes 16 which are provided with a number of electrodes 16*a* for the horizontal deflection. The display window 2 is provided on the inside with a luminescing phosphor screen 20, and an anode 21 manufactured from a thin metal film, for example by means of vacuum deposition of aluminium, is provided on the luminescing phosphor screen.

In the case of relatively small display devices the space between the second set of deflection electrodes 16 and the anode 21 can be left empty. However, in the case of large display devices it is recommended to provide a reinforcing construction 18 between the second set of deflection electrodes 16 and the anode 21 so that the high air pressure on the display window can be resisted. To facilitate deflection, stripe-shaped electrodes may be provided on the reinforcing construction 18, thereby forming a post-accelerating electrode.

An entire display device is composed of, for example, 15 of the segments shown in FIG. 1.

Figure 2:
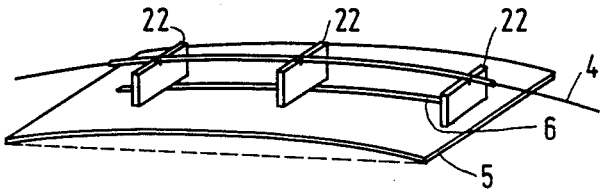
FIG. 2 is a diagrammatic perspective view of a preferred embodiment of a wire cathode positioned relative to a first electrode, in accordance with the invention.

A disadvantage of such a display device is that vibrations adversely affect its operation. The tensed thermionic linear wire cathodes are very sensitive to vibrations. Owing to these vibrations the distance from the wire cathode to the first electrode is unfavourably varied. The distance from the wire cathodes to the first electrode is important for the formation of the electron beams emerging from the apertures of the first electrode. The distance from the wire cathode to the first electrode determines the opening angle of the wire cathodes relative to the slits in the first electrode. A small distance results in a large opening angle so that many electrons emerge from the slits. In the case of a large distance, fewer electrons emerge from the slits. Consequently, when the distance to the first electrode varies over the length of the wire cathode, the electron beams are formed in a nonuniform manner. In accordance with the invention, this disadvantage is overcome by constructing the first electrode 5 so that it is bent, as is shown in perspective in FIG. 2. Juxtaposed positioning means 22 having the same shape are present between the wire cathode 4 and the first electrode 5. The positioning means 22 keep the wire cathode 4 at a well-defined distance from the slit 6 in the first electrode 5. The tensed wire cathode 4 urges the positioning means 22 against the aperture 6. The tension required depends on the extent to which the first electrode 5 is bent. Due to the fact that the positioning means 22 locally fix the distance between the first electrode 5 and the wire cathode 4, i.e. where the positioning means are urged against the bent first electrode 5, the distance between the wire cathode 4 and the bent first electrode 5 is less sensitive to variations caused by vibrations. Moreover, the free vibration lenth of the wire cathode 4 is reduced by the positioning means 22, i.e. the natural frequency (and the vibration frequency) is increased.

By selecting the number of positioning means 22 such that the vibration frequency to which the wire cathode is sensitive exceeds the customary frequencies of vibrations (for example loudspeaker vibrations and externally-induced vibrations), the wire cathode becomes less sensitive to microphonics.

Figure 3:
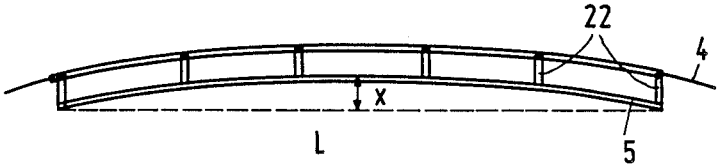
FIG. 3 is a diagrammatic sectional view of another preferred embodiment of a wire cathode positioned relative to a first electrode, in accordance with the invention.

The curvature of the bent first electrode 5 is represented by the ratio x:L, wherein L is the length of the first electrode 5 and x is the maximum deviation of the bent first electrode 5 in comparison with a straight electrode, as is shown in FIG. 3. In practice it is preferred that the curvature ranges between 0.001% and 1%. If the curvature is less than 0.001% the required mechanical tension to be applied to the wire cathode 4 to urge the positioning means 22 against the first electrode 5 is so large that the wire cathode 4 is plastically deformed or even fractured. In the case of curvature exceeding 1% the further deflection of the electron beams by the deflection electrodes is no longer uniform which adversely affects the operation of the display device.

Figure 4:
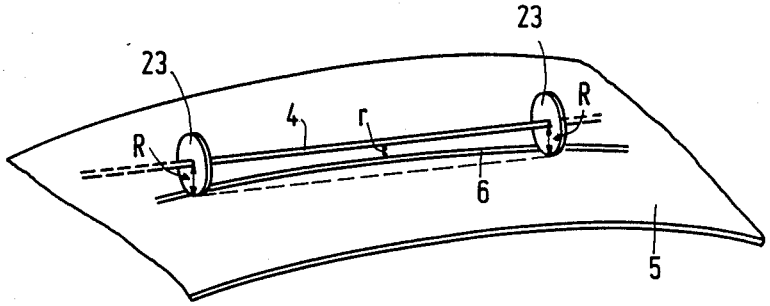
FIG. 4 is a perspective view of yet another preferred embodiment of a wire cathode positioned relative to a first electrode, in accordance with the invention.

In practive, a suitable spacing is attained when the positioning means 22 are constructed as discs having a radius R, as is shown in FIG. 4. To ensure that the first electrode 5 and the wire cathode 4 are electrically insulated, the positioning means 22 (discs 23) have to be manufactured from insulating material.

the wire cathode 4 extends in a straight line between the discs 23. Since the first electrode 5 is bent the distance from the wire cathode 4 to the first electrode 5 varies. The maximum distance is R, the radius of the discs 23, while the minimum distance is represented by r. The maximum variation of the distance between the wire cathode 4 and the first electrode 5 between two juxtaposed discs 23 is represented by the ratio (R−r):R. In practice it has been found that when this ratio is less than 15% the electron beams are formed in a sufficiently uniform manner.

In order not to adversely affect the emission of electrons by the wire cathode, the positioning means must not be too thick.

Figure 5:
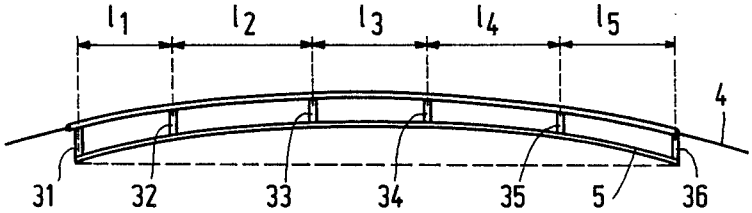
FIG. 5 is a sectional view of a further preferred embodiment of a wire cathode positioned relative to a first electrode, in accordance with the invention.

FIG. 5 is a sectional view of a preferred embodiment of a wire cathode which is positioned relative to a first electrode in accordance with the invention, the distance between two different pairs of juxtaposed positioning means being different. For example, the distance $l_1$ between the pair of juxtaposed positioning means 31, 32 differs from the distance $l_2$ between the pair of juxtaposed positioning means 32, 33. Consequently, the parts of the wire cathode 4 which are located between the positioning means 31, 32 and between the positioning means 32, 33 have different vibration frequencies. Consequently, a vibration of the wire-cathode part 4 located between the positioning means 31, 32 is not transmitted to the wire-cathode part between the positioning means 32, 33. It has been found in practice that owing to the fact that the distances between all pairs of positioning means are different, the wire cathode 4 is less sensitive to microphonics.

I claim:

1. A display device comprising an evacuated envelope having a flat display window which is provided with a luminescing phosphor screen, which envelope accommodates a tensed linear thermionic wire cathode for emitting electrons and a first electrode having with a slit for passing electrons, so that electron beams are formed, characterized in that the first electrode is bent convexly relative to the cathode and a number of juxtaposed positioning means are present between the linear thermionic wire cathode and the first electrode, the tensed wire cathode urging the positioning means against the slit in the first electrode.

2. A display device as claimed in claim 1, characterized in that the curvature of the first electrode ranges between 0.001% and 1% of the length of the first electrode.

3. A display device as claimed in claim 1, characterized in that between each two successive positioning means the distance from the wire cathode to the first electrode varies maximally 15%.

4. A display device as claimed in claim 2, characterized in that the distance between two different pairs of juxtaposed positioning means differs.

5. A display device as claimed in claim 1, characterized in that the positioning means are manufactured from electrically insulating material.

6. A display device as claimed in claim 1, characterized in that the positioning means are at least partly disc-shaped and provided on the wire cathode.

7. A display device as claimed in any one of the preceding claims, comprising a number of parallel disposed (mechanically) tensed linear thermionic wire cathodes having a first electrode for each wire cathode, characterized in that each wire cathode is positioned relative to the associated first electrode by means of positioning means, and that each first electrode is bent.

* * * * *